US009738469B2

(12) United States Patent
Sekigawa

(10) Patent No.: US 9,738,469 B2
(45) Date of Patent: Aug. 22, 2017

(54) SHEET CONVEYANCE APPARATUS AND IMAGE FORMING APPARATUS

(71) Applicant: CANON KABUSHIKI KAISHA, Tokyo (JP)

(72) Inventor: Akito Sekigawa, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/219,520

(22) Filed: Jul. 26, 2016

(65) Prior Publication Data

US 2017/0036873 A1 Feb. 9, 2017

(30) Foreign Application Priority Data

Aug. 6, 2015 (JP) ..... 2015-156177

(51) Int. Cl.
*B65H 3/44* (2006.01)
*B65H 3/66* (2006.01)

(52) U.S. Cl.
CPC ..... *B65H 3/44* (2013.01); *B65H 3/66* (2013.01); *B65H 2404/144* (2013.01); *B65H 2404/1521* (2013.01); *B65H 2601/11* (2013.01)

(58) Field of Classification Search
CPC ..... B65H 2601/11; B65H 3/44; B65H 5/36; B65H 2301/3121; B65H 2404/144; B65H 2404/1521
See application file for complete search history.

(56) References Cited

U.S. PATENT DOCUMENTS 6,739,778 B2 * 5/2004 Fuchi ..... B65H 3/44 399/110
6,973,279 B2 * 12/2005 Yokoi ..... G03G 21/1638 399/124
8,087,667 B2 1/2012 Sekigawa
8,240,664 B2 8/2012 Sekigawa
(Continued)

FOREIGN PATENT DOCUMENTS

EP 2851754 A1 3/2015
JP 01-308354 A 12/1989
(Continued)

OTHER PUBLICATIONS

Great Britain Office Action Issued in corresponding GB Application No. 1612486.9 dated Jan. 20, 2017.

*Primary Examiner* — Jeremy R Severson
(74) *Attorney, Agent, or Firm* — Fitzpatrick, Cella, Harper & Scinto

(57) ABSTRACT

A sheet conveyance apparatus includes a cover member including a first guide surface guiding a sheet and capable of switching between a close state and an open state with respect to the apparatus body, a guide member including a second guide surface opposing to the first guide surface, and a conveyance unit conveying a sheet through a path between the first guide surface and the second guide surface. The guide member includes an abutment portion formed of a depression in the second guide surface, and is supported pivotally on the apparatus body to an outer side of the apparatus body. The sheet conveyance apparatus further includes a regulation portion supported on the apparatus body and formed to abut against the abutment portion so as to regulate a pivot angle of the guide member.

11 Claims, 9 Drawing Sheets

(56) References Cited

U.S. PATENT DOCUMENTS

| | | | | |
|---|---|---|---|---|
| 8,620,183 | B2 * | 12/2013 | Hosoi | B65H 5/38 399/124 |
| 9,067,753 | B2 | 6/2015 | Tokuma et al. | |
| 9,268,287 | B2 * | 2/2016 | Maruyama | G03G 15/6529 |
| 2006/0280533 | A1 | 12/2006 | Ozawa | |
| 2008/0253802 | A1 * | 10/2008 | Koyanagi | G03G 15/16 399/114 |
| 2010/0327510 | A1 * | 12/2010 | Matsuno | B41J 11/006 271/3.14 |
| 2015/0158688 | A1 * | 6/2015 | Aoki | B65H 3/56 271/3.19 |
| 2015/0261166 | A1 * | 9/2015 | Takahashi | B65H 1/266 271/3.2 |

FOREIGN PATENT DOCUMENTS

| | | | |
|---|---|---|---|
| JP | 06-016277 | A | 1/1994 |
| JP | 2770321 | B2 | 4/1998 |
| JP | 2008-102298 | A | 5/2008 |

* cited by examiner

SHEET CONVEYANCE APPARATUS AND IMAGE FORMING APPARATUS

BACKGROUND OF THE INVENTION

Field of the Invention

The present invention relates to a sheet conveyance apparatus conveying sheets, and an image forming apparatus equipped with the same.

Description of the Related Art

In the case in which sheet jam or other abnormalities occur within an image forming apparatus, it is desirable that an operator such as a user or a service engineer has a prompt solution to access internal components of the apparatus so that restoring operations are enabled. Japanese Patent Publication No. 2770321 discloses an image forming apparatus having a first chute member that moves in swinging motion corresponding to opening and closing of a cover member, and a second chute member forming a sheet conveyance path between the first chute member and capable of moving in swinging motion with respect to a body frame. According to the image forming apparatus, when the operator opens the cover member, the second chute member positioned on an inner side of the first chute member is pivoted toward an outer side of the apparatus body by its own weight. Thereby, the member positioned on an inner side of the second chute member is exposed, and a state is realized where the operator can perform restoring operations.

When a guide member pivoting to the outer side of the apparatus body, such as the second chute member according to the above patent document, is provided, the guide member may interfere with other members in pivoting to a large pivot angle. In order to cope with the problem, a regulation member may be provided to regulate a pivoting range of the guide member by abutting against a guide surface, i.e., outer side surface with respect to the apparatus body, of the guide member. However, if such regulation member is provided, scratch marks and other damages formed on the guide surface by the regulation member may cause such a conveyance abnormality that the sheet is caught by the damaged portion, and the conveyance performance of the sheet may be deteriorated.

SUMMARY OF THE INVENTION

According to one aspect of the present invention, a sheet conveyance apparatus includes an apparatus body, a cover member including a first guide surface configured to guide a sheet, the cover member being configured to switch between a close state and an open state with respect to the apparatus body, a guide member supported on the apparatus body pivotally to an outer side of the apparatus body, the guide member including a second guide surface opposing to the first guide surface and an abutment portion configured to be depressed from the second guide surface, a conveyance unit configured to convey a sheet through a path between the first guide surface and the second guide surface, and a regulation portion supported on the apparatus body. The regulation portion is formed to abut against the abutment portion in a state where the cover member is switched from the close state to the open state so that a pivot angle of the guide member is regulated not to exceed a predetermined angle.

Further features of the present invention will become apparent from the following description of exemplary embodiments with reference to the attached drawings. The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Now, preferred embodiments of the present disclosure will be described with reference to the drawings. In the following description, a state in which an image forming apparatus is seen from a front side, i.e., viewpoint of FIG. 1, is used as reference to describe positional relationships in vertical and left-and-right directions.

Image Forming Apparatus

Figure 1:
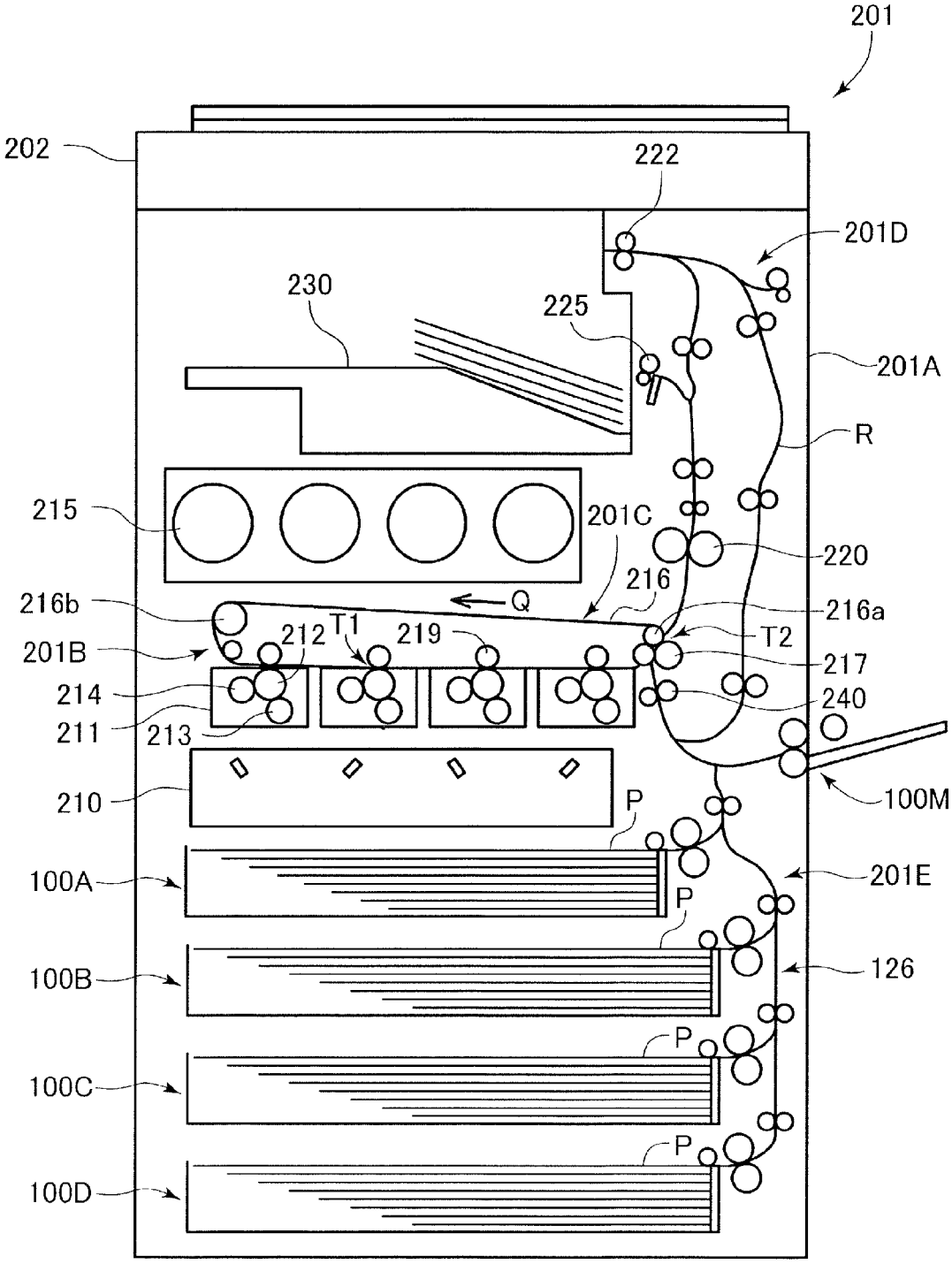
FIG. 1 is a schematic view of an image forming apparatus according to the present embodiment.

An image forming apparatus 201 according to the present embodiment is a full-color laser beam printer, a general arrangement of which is illustrated in FIG. 1. The image forming apparatus 201 includes an image forming unit 201B forming an image on a sheet P, a fixing unit 220 fixing an image on the sheet P, and so on in an interior of an apparatus body (printer body) 201A, i.e., an image forming apparatus body. An image reading apparatus 202 reading an image data of a document is arranged in an upper portion of the apparatus body 201A while a supporting surface of the document being positioned approximately horizontally. A sheet discharge tray 230 is provided in a discharge space to which the sheet P is discharged between the image reading apparatus 202 and the apparatus body 201A. Further, a sheet feeding unit 201E feeding sheets P to the image forming unit 201B is provided in the apparatus body 201A. The sheet feeding unit 201E includes sheet feeding apparatuses 100A, 100B, 100C and 100D arranged vertically at a lower portion of the apparatus body 201A, and a manual sheet feeding apparatus 100M arranged at a right side portion of the apparatus body 201A.

The image forming unit 201B is a so-called four-drum full-color image forming unit having a laser scanner 210, four process cartridges 211, and an intermediate transfer unit 201C. The process cartridges form toner images of respective colors, which are yellow (Y), magenta (M), cyan (C) and black (K). Each process cartridge 211 include a photosensitive drum 212 composed of photoconductor, i.e., image bearing member, a charger 213, i.e., charging unit, a developer 214, i.e., image developing unit, and a cleaner, i.e., cleaning unit, not shown. A toner cartridge 215 storing toners of respective colors is detachably attached to the apparatus body 201A at an upper portion of the image forming unit 201B.

The intermediate transfer unit 201C includes an intermediate transfer belt 216, i.e., intermediate transfer body, wound around a drive roller 216*a* and a tension roller 216*b*, and the unit is arranged above the four process cartridges 211. The intermediate transfer belt 216 is arranged to contact the photosensitive drums 212 of the respective process cartridges 211, and driven to rotate in a counterclockwise direction, i.e., direction of arrow Q, by the drive roller 216*a* driven by a drive unit not shown. The intermediate transfer unit 201C has primary transfer rollers 219 that contact an inner circumferential surface of the intermediate transfer belt 216 at positions opposing to the respective photosensitive drums 212, and primary transfer portion T1 are formed as nip portions of the intermediate transfer belt 216 and the photosensitive drums 212. Further, the image forming unit 201B includes a secondary transfer roller 217 that contacts an outer circumferential surface of the intermediate transfer belt 216 at a position opposing to the drive roller 216*a*. A secondary transfer portion T2 where a toner image borne on the intermediate transfer belt 216 is transferred to the sheet P is formed as a nip portion of the secondary transfer roller 217 and the intermediate transfer belt 216.

In the respective process cartridges 211 arranged as described, an electrostatic latent image is drawn on the surface of the photosensitive drum 212 by the laser scanner 210, and toner is supplied from the developers 214 to form toner images of respective colors charged with negative polarity. The toner images are sequentially transferred in multi layers, i.e., primarily transferred, to the intermediate transfer belt 216 at the respective primary transfer portion T1 by applying a transfer bias voltage of positive polarity to the primary transfer rollers 219, and a full-color toner image is formed on the intermediate transfer belt 216.

Simultaneously as the above-described toner image forming process, the sheet P fed from the sheet feeding unit 201E is conveyed toward a registration roller pair 240, where skewing of the sheet P is corrected by the registration roller pair 240. The registration roller pair 240 conveys the sheet P to the secondary transfer portion T2 at a timing matching the transfer timing of the full-color toner image formed on the intermediate transfer belt 216. The toner image borne on the intermediate transfer belt 216 is secondarily transferred to the sheet P at the secondary transfer portion T2 by applying a transfer bias voltage of positive polarity to the secondary transfer roller 217.

The sheet P to which the toner image has been transferred is heated and pressed by the fixing unit 220, and a color image is fixed onto the sheet P. The sheet P with the image fixed thereto is discharged by a discharge roller pair 225 to the sheet discharge tray 230 and supported on the tray. When images are to be formed on both sides of the sheet P, the sheet P having passed the fixing unit 220 is moved in switch-back motion by a reverse conveyance roller pair 222 capable of forward/reverse rotation provided in a reverse conveyance unit 201D. Thereafter, the sheet P is conveyed again to the image forming unit 201B via a re-conveyance path R, so that an image is formed on the rear side of the sheet P.

Sheet Feeding Apparatus

Next, a configuration of the sheet feeding apparatus will be described with reference to the sheet feeding apparatus 100C, the third one from the top. The first, second and fourth sheet feeding apparatuses 100A, 100B and 100D from the top include similar components as the sheet feeding apparatus 100C, so that components having a similar configuration and operation are denoted with the same reference numbers, and detailed descriptions thereof will be omitted. It is noted that while the image forming apparatus 201 according to the present embodiment includes four sheet feeding apparatuses 100A, 100B, 100C and 100D, a similarly configured sheet feeding apparatus can additionally be provided below the sheet feeding apparatus 100D, for example.

Figure 2:
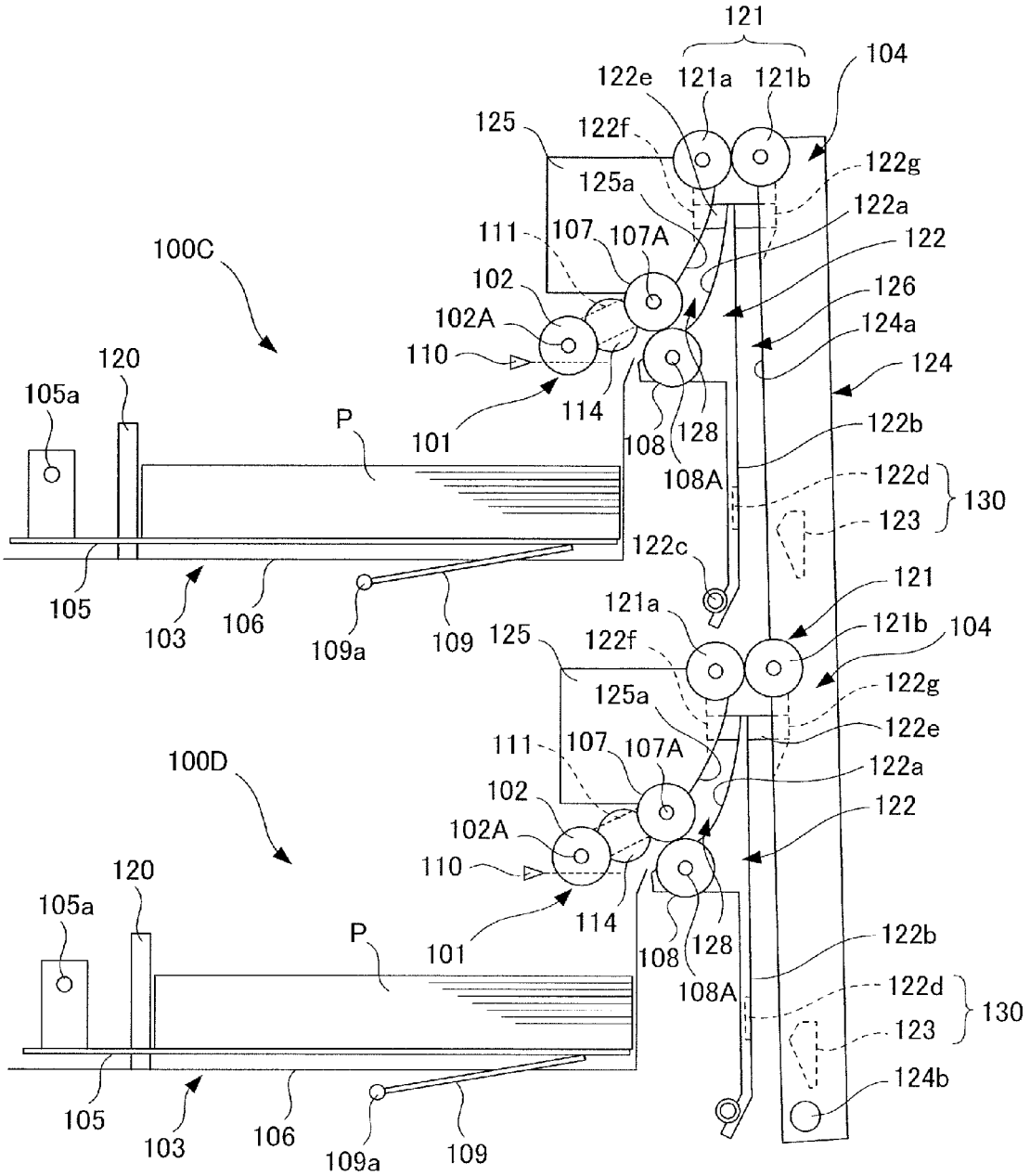
FIG. 2 is a front view of a sheet feeding apparatus according to the present embodiment.

As illustrated in FIG. 2, the sheet feeding apparatus 100C includes a cassette 103, a feeding unit 101, and a sheet conveyance unit 104, and feeds the sheet P via a vertical path 126 (refer to FIG. 1) extending along a vertical direction within the apparatus body 201A. The cassette 103, i.e., a storage portion, or a supporting unit supporting the sheets P, includes a cassette case 106, a tray 105, a tray lifting plate 109, a trailing end regulating plate 120, and so on. The cassette case 106 is removably mounted on the apparatus body 201A by being moved along a front-rear direction, i.e., perpendicular direction to the page of FIG. 1, from a front side of the image forming apparatus 201. The tray 105 supports the sheets P and is lifted and lowered and the tray lifting plate 109 lifting and lowering the tray 105 are stored in the cassette case 106. The trailing end regulating plate 120 is provided to contact a trailing end portion of the sheet P supported on the tray 105 in a sheet feed direction, and determines the position of the sheet P by abutting with the trailing end portion of the sheet P and having a front end portion thereof abutted against an inner wall of the cassette case 106.

The tray 105 has a lower portion supported by the tray lifting plate 109, and disposed pivotally in a vertical direction around a pivot shaft 105*a* provided at an upstream side, i.e., left side in FIG. 2, in a sheet feeding direction than the trailing end regulating plate 120. The tray lifting plate 109 is connected via a drive transmission portion to a lifting motor not shown, and the tray lifting plate lifts up (elevates) the tray 105 by being driven by the lifting motor and pivoting around the pivot shaft 109*a* along the vertical direction.

The feeding unit 101 separating and feeding the sheets P supported on the cassette 103 one by one includes a pickup roller 102, a feed roller 107, a separation roller 108, and so on. These rollers (102, 107 and 108) are arranged so that axial directions thereof are arranged in a direction orthogonal to a sheet feeding direction, that is, in a perpendicular direction to the page of FIG. 2. The feed roller 107 is attached to a sheet feed drive shaft 107A supported pivotally on a sheet feed frame 125. The sheet feed drive shaft 107A is connected via a drive transmission portion to a sheet feed motor not shown, and rotates the feed roller 107 along the sheet feeding direction. The separation roller 108 is attached to a separation roller shaft 108A having a fixed relative position with respect to the sheet feed drive shaft 107A, and a rotation in a reverse direction as the feed roller 107 is entered to the separation roller 108 via a torque limiter not shown.

An elevating plate 111 extending upstream in the sheet feeding direction is supported on the sheet feed drive shaft 107A and pivotable in a vertical direction. The pickup roller 102 is attached to a pickup roller shaft 102A pivotally supported on a leading end portion of the elevating plate 111, and connected to the sheet feed drive shaft 107A via an idler gear 114 supported by the elevating plate 111. A transmission-type (thrubeam-type) height detection sensor 110 capable of detecting a height position of the elevating plate 111 is arranged near the elevating plate 111. The height detection sensor 110 generates an ON signal by detecting a detection flag not shown provided on the elevating plate 111 when the feed roller 107 is at a predetermined height position that is set such that the feed roller 107 contacts a sheet supported on the tray 105 (hereinafter referred to as a sheet feeding position).

The sheet conveyance unit 104 includes a conveyance roller pair (vertical-path roller) 121, i.e., conveyance unit, a duplex guide 122, i.e., guide member, an openable cover 124, i.e., cover member, and a stopper 123, i.e., regulation portion. The sheet conveyance unit 104 is a sheet conveyance apparatus conveying the sheet P via the vertical path 126 formed between the openable cover 124 and the duplex guide 122.

The conveyance roller pair 121 is composed of a first conveyance roller 121*a* rotatably supported by the apparatus body via the sheet feed frame 125 and a second conveyance roller 121*b* rotatably supported by the openable cover 124. The conveyance roller pair 121 is arranged downstream, in a sheet feeding direction, of the feed roller 107. At least one of the first and second conveyance rollers 121*a* and 121*b* of the conveyance roller pair 121 is connected to a conveyance motor not shown via a drive transmission portion, and the rollers convey the sheet P received from the feed roller 107 to the upper direction.

The duplex guide 122 is arranged between the cassette 103 and the openable cover 124, and a surface on the side of the openable cover 124 and a surface on the side of the cassette 103 are both formed as guide surfaces. In the duplex guide 122, a vertical-path guide surface 122*b*, i.e., second guide surface, opposing to the openable cover 124 forms a part of the vertical path 126 extending along the vertical direction between a guide surface 124*a*, i.e., first guide surface, of the openable cover 124. A feeding-path guide surface 122*a*, i.e., third guide surface, facing to a guide surface 125*a* provided on the sheet feed frame 125 while forming a feeding path 128, is provided on an opposite side from the vertical-path guide surface 122*b* of the duplex guide 122. The feeding-path guide surface 122*a* is formed in a smoothly curved manner from an upper right direction, i.e., feeding direction by the feed roller 107, to an upper direction, i.e., conveyance direction by the conveyance roller pair 121, and the sheet P sent from the feed roller 107 is guided toward the conveyance roller pair 121. An upper end portion of the duplex guide 122 is positioned below the conveyance roller pair 121, and the feeding path 128 and the vertical path 126 are merged at a position below a nip portion of the conveyance roller pair 121. In other words, the feeding-path guide surface 122*a* formed in a curved manner when seen from a sheet width direction orthogonal to the conveyance direction of the sheet is connected to a downstream end of the vertical-path guide surface 122*b* at a downstream end.

Figure 3:
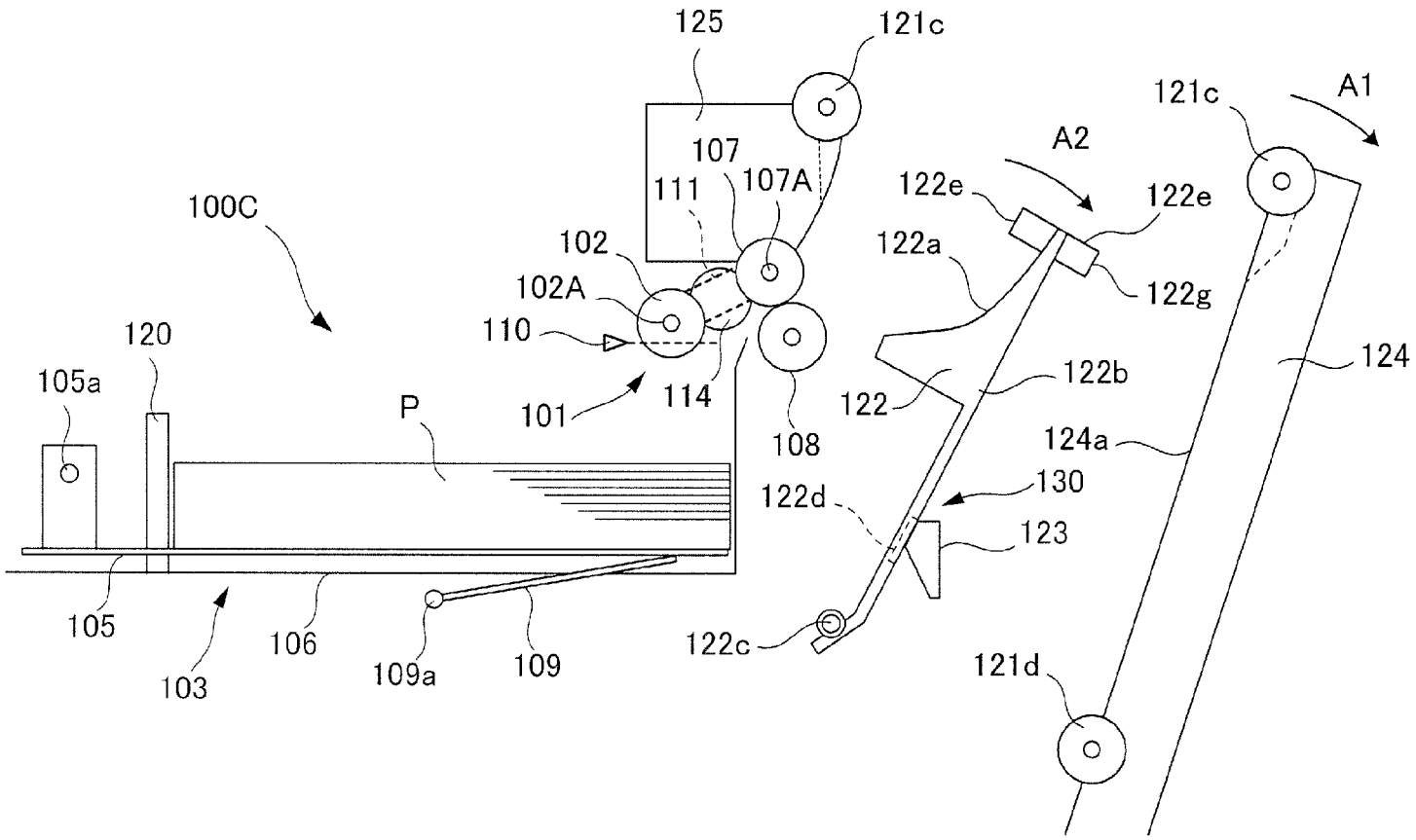
FIG. 3 is a front view of a sheet feeding apparatus of a case where an openable cover is opened.

As illustrated in FIGS. 2 and 3, the openable cover 124 is pivotally supported on a cover pivot shaft 124*b* disposed on a lower portion. The openable cover 124 is an opening/closing member disposed in a switchable manner between a close state, i.e., state shown in FIG. 2, covering a part of a right side surface of the apparatus body 201A, and an open state, i.e., state shown in FIG. 3, pivoted rightward from the close state. The duplex guide 122 of the sheet feeding apparatus 100C and the duplex guide 122 of the sheet feeding apparatus 100D are arranged vertically one above the other, and the guide surface 124*a* of the openable cover 124 is opposed to the respective vertical-path guide surfaces 122*b* of these duplex guides 122. Further, the openable cover 124 rotatably supports the second conveyance roller 121*b* of the sheet feeding apparatus 100D. Therefore, when the openable cover 124 is operated to be opened, the components of both the sheet feeding apparatuses 100C and 100D are simultaneously exposed to the exterior of the apparatus.

The duplex guide 122 is a pivotal guide, i.e., swing guide, provided pivotally (swingably) in a left-and-right direction around a guide shaft 122*c* disposed on a pivot axis located in a lower part, i.e., upstream part in the conveyance direction, of the duplex guide 122. A fixing portion 122*e* is provided on both end portions in a width direction, i.e., perpendicular direction to the page of FIG. 2, on the upper part of the duplex guide 122, and the fixing portion 122*e* is projected toward the openable cover 124 and the sheet feed frame 125. When the openable cover 124 is in a close state, a cover-side contact surface 122*g* of the fixing portion 122*e* contacts the openable cover 124, whereas a body-side contact surface 122*f* of the fixing portion 122*e* contacts the sheet feed frame 125. That is, the position of the duplex guide 122 is fixed by having the fixing portion 122*e* sandwiched between the openable cover 124 and the sheet feed frame 125, and the vertical path 126 and the feeding path 128 are thus defined. As described later, when the openable cover 124 is operated to be opened, the duplex guide 122 pivots by its own weight, and further pivoting beyond a predetermined amount is regulated by a regulation mechanism 130.

Sheet Feeding Operation

Next, a sheet feeding operation of the sheet feeding apparatus 100C configured as above will be described. When a command to feed a sheet from a control unit in the apparatus body 201A to the sheet feeding apparatus 100C is received, the sheet feed motor and a conveyance motor (both are not shown) are started, and the sheet feeding operation is started. An uppermost sheet P supported on the cassette 103 is retained at a predetermined height by having the tray 105 raised by the tray lifting plate 109.

When the rotation of the sheet feed motor is entered to the sheet feed drive shaft 107A, the feed roller 107, the separation roller 108 and the pickup roller 102 respectively start to rotate, while the elevating plate 111 is lowered to a position where the pickup roller 102 reaches the sheet feeding position. When the pickup roller 102 reaches the sheet feeding position and contacts the uppermost sheet P, the uppermost sheet P is picked up and conveyed toward the feed roller 107, and the sheet P is further conveyed by the feed roller 107 via the feeding path 128 toward the conveyance roller pair 121. At this time, the reverse rotation inputted to the separation roller 108 prevents a plurality of sheets P from entering between the feed roller 107 and the separation roller 108, that is, prevents duplex feeding.

When the sheet P sent from the feed roller 107 reaches the conveyance roller pair 121, the sheet P is conveyed upward through the vertical path 126 by the conveyance roller pair 121. The sheet P is further conveyed via the conveyance roller pairs 121 of the first and second sheet feeding apparatuses 100A and 100B, reaches the registration roller pair 240, and supplied to the image forming unit 201B. Further, the sheet conveyance unit 104 of the sheet feeding apparatus 100C also operates when the sheet P is fed from a sheet feeding apparatus disposed below. That is, the sheet conveyance unit 104 of the sheet feeding apparatus 100C conveys the sheet P sent via the conveyance roller pair 121 of the sheet feeding apparatus 100D to the upper direction. Thereby, the duplex guide 122 guides the sheet P conveyed from the sheet feeding apparatus 100D in the vertical-path guide surface 122*b*, i.e., second guide surface, and the sheet P conveyed from the sheet feeding apparatus 100C in the feeding-path guide surface 122*a* respectively to the image forming portion. The cassette 103 of the sheet feeding apparatus 100C is an example of a first sheet storage portion positioned in a lower portion of the image forming portion, and the cassette 103 of the sheet feeding apparatus 100D is an example of a second sheet storage portion positioned below the first sheet storage portion.

Detailed Arrangement of Regulation Mechanism

Next, a regulation mechanism 130 regulating the pivoting of the duplex guide 122 will be described in detail. The regulation mechanism 130 includes, as illustrated in FIG. 2, an abutment portion 122*d* formed of a depression (recess) in the vertical-path guide surface 122*b* of the duplex guide 122, and a stopper 123 fixed to the apparatus body 201A. It is noted that while the stopper 123 is illustrated within the openable cover 124 in FIG. 2, the stopper 123 is actually supported on the body 201A of the image forming apparatus 201. The stopper 123 contacts the abutment portion 122*d* when the openable cover 124 is opened, and prevents the duplex guide 122 from pivoting to an angle beyond a predetermined angle (refer to FIG. 3). Here, the predetermined angle refers to an angle set so as to enable the sheet P to be removed easily when the sheet P is jammed between the feeding-path guide surface 122*a* of the duplex guide 122 and the sheet feed frame 125, or in the feeding path 128.

Figure 4:
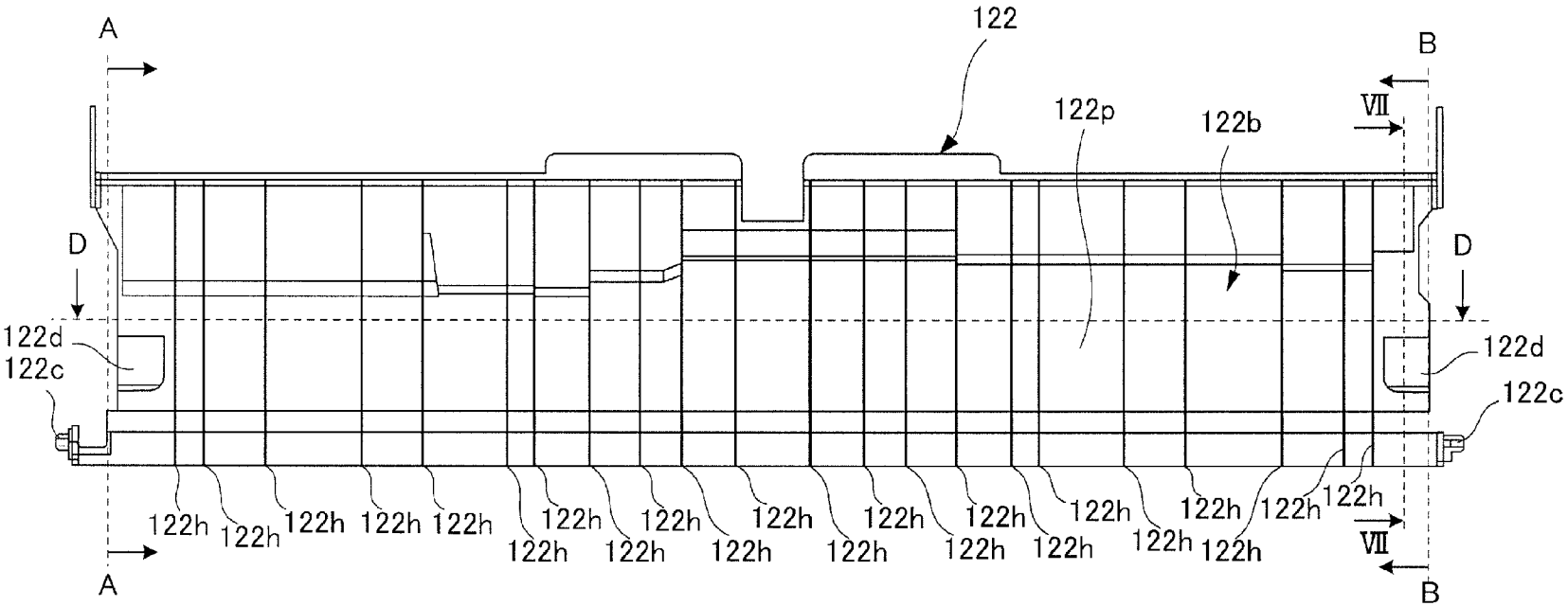
FIG. 4 is a side view of a duplex guide seen from a side of a vertical path.

The abutment portions 122*d*, which are abutment surfaces for the stopper 123, are disposed on both sides of the duplex guide 122 in the width direction of the sheet P and disposed within a range of a conveyance area of the vertical-path guide surface 122*b*, as illustrated in FIG. 4. The abutment portions 122*d* and 122*d* are examples of a first abutment portion and a second abutment portion arranged on one side and another side in the width direction of the guide member. Further, the stoppers 123 and 123 respectively coming in contact with the abutment portions 122*d* and 122*d* are examples of a first regulation portion and a second regulation portion. The conveyance area of the vertical-path guide surface 122*b* refers to an area to be in contact with the sheet P and configured to function as a guide. The range in the width direction of the sheet P of the conveyance area refers to an inner side of a maximum width of the sheet P to be conveyed by the conveyance roller pair 121, that is, the range defined by dashed line A-A and dashed line B-B in the present embodiment.

The vertical-path guide surface 122*b* is formed so that guide ribs 122*h*, i.e., ribs extending along a sheet feeding direction (vertical direction of FIG. 4), are provided in a projected manner on a smooth flat surface 122*p* opposing to the guide surface 124*a* of the openable cover 124. The guide ribs 122*h* are arranged at a plurality of positions in the width direction of the sheet P, and the abutment portions 122*d* are formed to be depressed from the flat surface 122*p* at positions not overlapping with the guide ribs 122*h* in the width direction. It is noted that the abutment portion 122*d* is disposed at a position closer to the guide shaft 122*c*, i.e., pivot axis of the duplex guide 122, than a center position shown by dashed line D-D of the vertical-path guide surface 122*b* in the sheet feeding direction.

Figure 5:
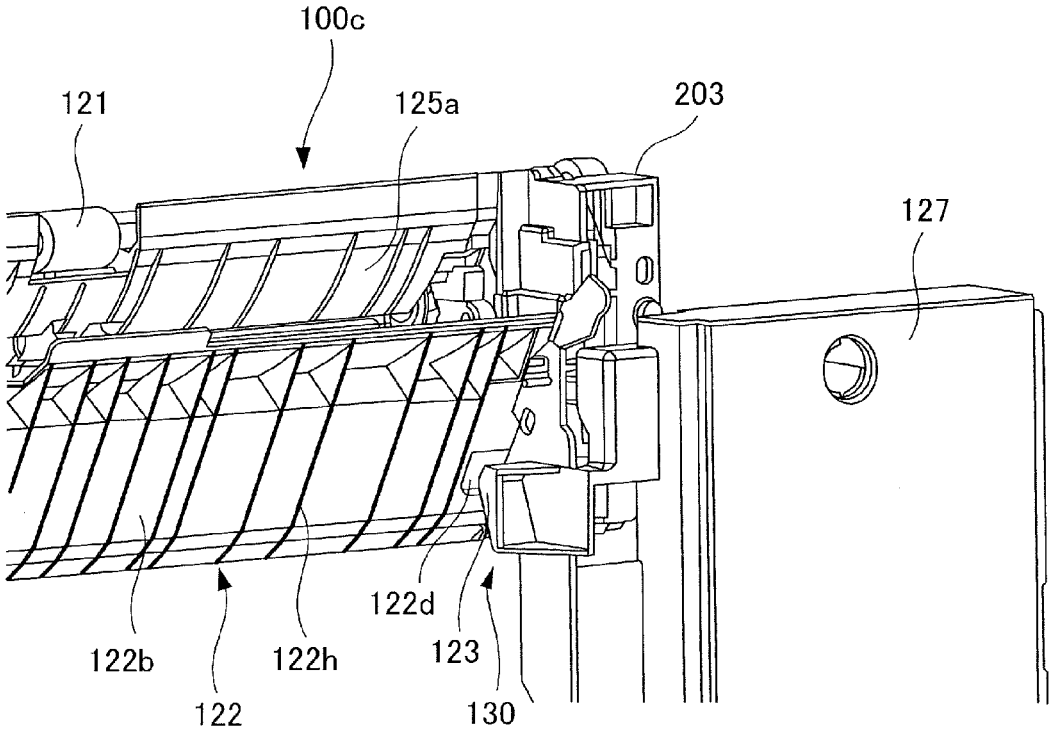
FIG. 5 is a perspective view of the duplex guide and a regulation portion.
Figure 6:
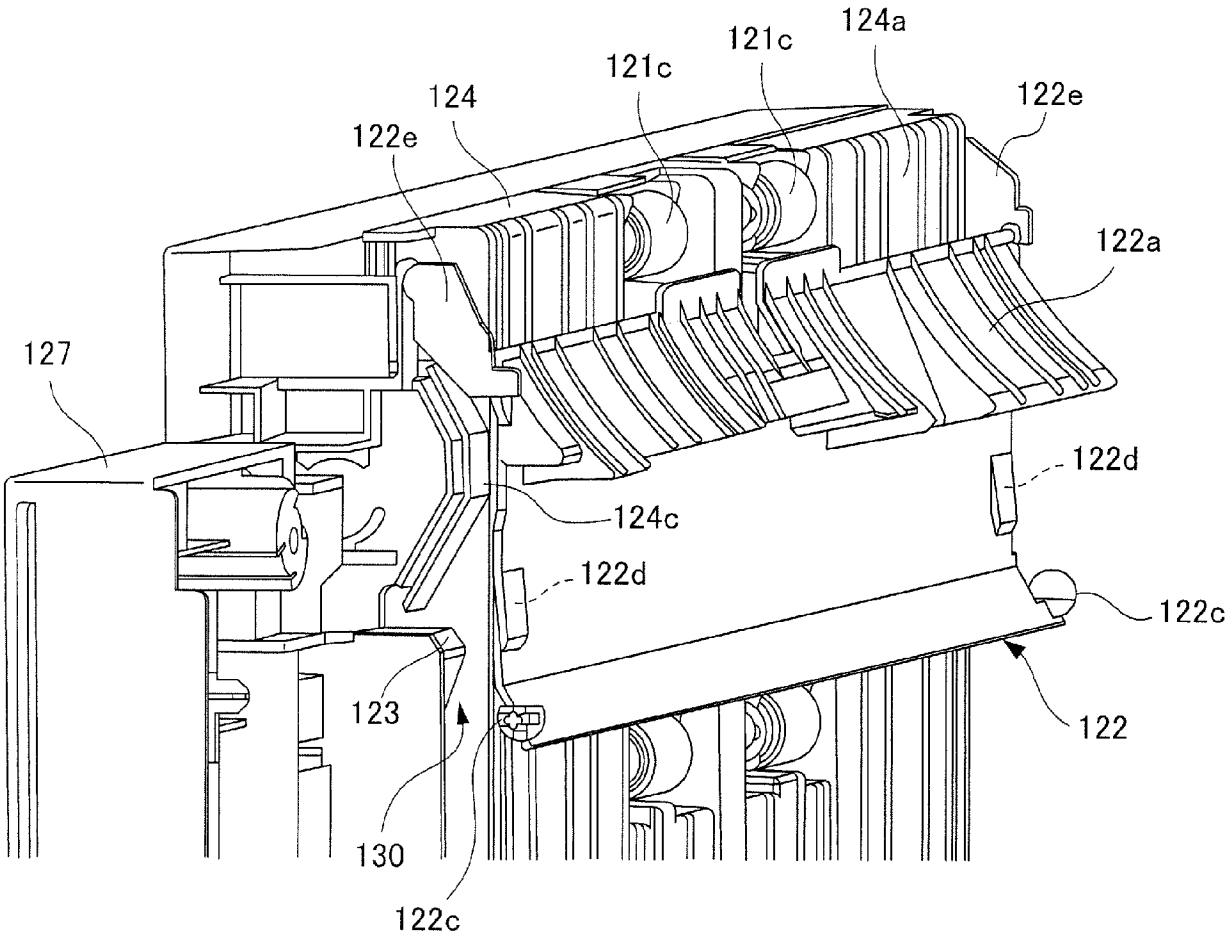
FIG. 6 is a perspective view showing the duplex guide, the regulation portion and the openable cover.

The stoppers 123, i.e., regulation portions, are fixed to a body frame 203, i.e., frame body of the apparatus body 201A, and arranged at positions capable of abutting against the abutment portions 122*d*, as illustrated in FIGS. 5 and 6. In other words, when the openable cover 124 is in a close state, the stoppers 123 are positioned at both side portions in the width direction of the sheet P within the conveyance area of the guide surface 124*a* of the openable cover 124. Further, the stoppers 123 are arranged at a lower portion of side guiding portions 124*c*, i.e., both side portions in the width direction of the guide surface 124*a*. In the present embodiment, the stoppers 123 are formed as a whole with an exterior cover 127 covering a rear side portion of the right side surface of the apparatus body 201A.

Figure 7A:
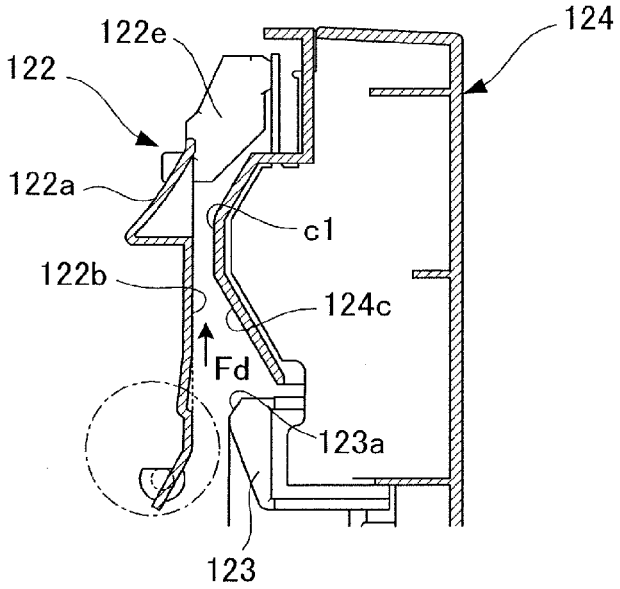
FIG. 7A is a cross-sectional view of the duplex guide and the openable cover illustrated in FIG. 4 in a state where the openable cover is in a close state.
Figure 7B:
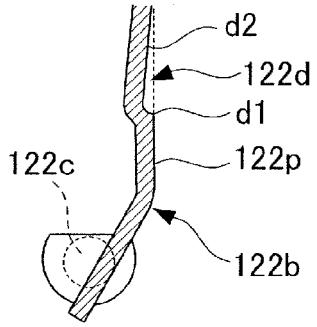
FIG. 7B is an enlarged view having enlarged the area shown by the dashed line in FIG. 7A.
Figure 7C:
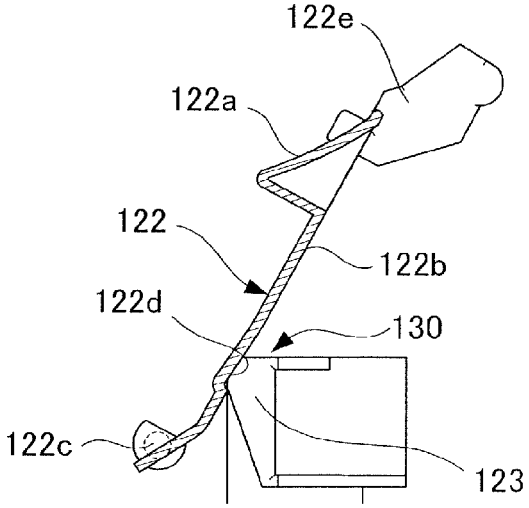
FIG. 7C is a cross-sectional view of the duplex guide in a state where the openable cover is in an open state.

The cross-sectional shapes of the abutment portion 122*d* and the stopper 123 will be described with reference to FIGS. 7A through 7C, which are cross-sectional views taken at dashed line VII-VII of FIG. 4. FIG. 7A illustrates the duplex guide 122 and the regulation mechanism 130 of a case where the openable cover 124 is in a close state, and FIG. 7B illustrates an enlarged view of an area of FIG. 7A surrounded by the dotted-dashed line. FIG. 7C illustrates the duplex guide 122 and the regulation mechanism 130 of a case where the openable cover 124 is in an open state.

As illustrated in FIGS. 7A and 7B, the abutment portion 122*d* includes a stepped portion d1 dented in a stepped shape from the flat surface 122*p* at an upstream side in the sheet feeding direction, i.e., direction of arrow Fd, and an inclined surface d2 inclined to be connected smoothly and successively to the flat surface 122*p* at the downstream side. Therefore, the shape of the whole body of the abutment portion 122*d* is depressed from the position of the flat surface 122*p*, i.e., position of the dashed line, in a direction away from the openable cover 124.

The stopper 123 includes a contact surface 123*a* opposing to the abutment portion 122*d*, and the contact surface 123*a* is formed to be inclined at a matching angle with the inclined surface d2 so as to be in surface contact with the inclined surface d2 of the abutment portion 122*d* (refer to FIG. 7C). Further, when the openable cover 124 is in a close state, the contact surface 123*a* is at a position more distant from the vertical-path guide surface 122*b* than a closest portion c1 positioned closest to the vertical-path guide surface 122*b* of the side guiding portions 124*c* of the guide surface 124*a*.

Opening and Closing Operation of Openable Cover

Next, the operation of the duplex guide 122 formed as above during the switching of the openable cover 124 between the open state and the close state will be described. As described, when the openable cover 124 is in the close state (FIG. 2 and FIG. 7A), the duplex guide 122 is fixed by being sandwiched between the openable cover 124 and the sheet feed frame 125 at the fixing portion 122*e*. At this time, the abutment portions 122*d* and the stoppers 123 of the regulation mechanism 130 are separated.

In this state, when the openable cover 124 is opened toward the right direction, that is, in the direction of arrow A1 of FIG. 3, and switched to the open state, the fixing portion 122*e* is released, and the duplex guide 122 starts pivoting toward the right direction, that is, in the direction of arrow A2, by its own weight. When the pivot angle of the duplex guide 122 reaches the predetermined angle, the abutment portions 122*d* abut against the contact surface 123*a* of the stoppers 123, and the pivoting of the duplex guide 122 stops (refer to FIGS. 3, 5 and 7C). Thereby, when the openable cover 124 is in the open state, the duplex guide 122 is regulated such that the pivoting angle does not exceed the predetermined angle.

When a closing operation of switching the openable cover 124 from an open state to a close state, i.e., pivoting operation to the left direction, is performed, the duplex guide 122 comes into contact with the openable cover 124 at the fixing portion 122*e*, and pivots toward the left along with the pivoting of the openable cover 124. At this time, the abutment portions 122*d* of the regulation mechanism 130 and the contact surfaces 123*a* of the stoppers 123 are separated. When the openable cover 124 reaches a position in the close state, the fixing portion 122*e* is sandwiched between the openable cover 124 and the sheet feed frame 125 again, by which the duplex guide 122 is fixed, and the sheet conveyance unit 104 will be in a state capable of conveying the sheet P.

According to the present embodiment, the duplex guide 122 of the sheet conveyance unit 104 pivots toward the outer side of the apparatus body 201A along with the opening operation of the openable cover 124. Therefore, members arranged on an inner side of the duplex guide 122 are exposed and can be accessed easily by opening the openable cover 124. In the present embodiment, the duplex guide 122 and the sheet feed frame 125 are separated when the openable cover 124 is opened, so that the sheet P and the like caught in the feeding path 128 can be removed easily, for example. Further, the duplex guide 122 is kept from pivoting beyond a predetermined angle by the regulation mechanism 130, so that the duplex guide 122 will not interfere with other members.

In a sheet conveyance unit 104 configured as above, the abutment portion 122*d* of the regulation mechanism 130 according to the present embodiment is formed in a depressed manner from the vertical-path guide surface 122*b* of the duplex guide 122. Therefore, the sheet P conveyed through the vertical path 126 can be prevented from coming into contact with the abutment portion 122*d*. This configuration reduces the chance of conveyance failure in which the sheet P is caught at a part of conveyance path, even when the abutment portions 122*d* abut against the stoppers 123 during the opening and closing operation of the openable cover 124, and damages such as scratch marks are formed on the abutment portions 122*d*.

Here, it is conceivable to adopt another configuration, as a first comparative example regarding the present embodiment, where an abutment portion is provided outside the conveyance area of the vertical-path guide surface 122*b*. That is, this comparative example includes the duplex guide 122 having abutment portions formed as projected portions projecting outward in the width direction of the dashed line A-A or the dashed line B-B of FIG. 4, while stoppers fixed to the apparatus body 201A abut against the projected portions. It is expected that this configuration prevents the sheet P from being caught by the scratch marks formed on the abutment portions.

However, according to this comparative configuration, the abutment portion protrudes to the outer side of the conveyance area of the duplex guide 122, so that the space occupied by the duplex guide 122 will become greater in the width direction as compared to the present embodiment. As a result, the size of the apparatus may become larger. On the other hand, according to the duplex guide 122 of the present embodiment, the abutment portions 122*d* are provided within the conveyance area of the vertical-path guide surface 122*b*, and the stoppers 123 are similarly provided within the conveyance area of the guide surface 124*a* of the openable cover 124. In other words, the regulation mechanism 130 of the present embodiment is disposed using a portion of, the vertical path 126 through which the sheet P passes, so as to minimize increase in size of the apparatus even when providing the regulation mechanism 130.

Further, an example of providing regulation portions in a vicinity of the pivot shaft of the duplex guide 122 is considered as a second comparative example regarding the present embodiment. That is, this comparative example adopts a configuration where cam members are attached to the guide shaft 122*c*, and regulation members are provided regulating the pivoting movement of the guide shaft by being engaged with the cam members when the duplex guide 122 reaches a predetermined angle. According to this configuration, it may be possible to suppress the occupation space of the duplex guide from being increased, while preventing the sheet P from getting caught by the scratch marks and the like formed on the abutment portion.

However, according to this configuration, when the user touches the duplex guide 122 when removing the sheet P, for example, the moment applied on the duplex guide 122 will be received at an area close to the pivot shaft. Then, a large force is applied on the cam member and the regulation member, so that measures must be taken such as providing a plurality of cam members and regulation members to prevent the apparatus from being damaged. In this case, the configuration of the apparatus may become complex and the size of the apparatus may be increased, thereby causing increase of the related costs. On the other hand, the stoppers 123 according to the present embodiment is configured to abut against the abutment portions 122*d* at positions between the guide shaft 122*c* provided at a lower portion of the duplex guide 122 and the upper end portion of the duplex guide 122. Therefore, the required strength of the abutment portions 122*d* and the stoppers 123 will be small as compared to the second comparative example, and a simpler configuration is adopted as compared to the second comparative example, while preventing the sheet P from getting caught without increasing the space occupied by the duplex guide.

The vertical-path guide surface 122*b* according to the present embodiment includes the flat surface 122*p* and the guide ribs 122*h* formed in a projected manner on the flat surface 122*p*, and the abutment portions 122*d* formed in a depressed manner on the flat surface 122*p*. In other words, the abutment portions 122*d* are further dented from the flat surface 122*p* that is arranged at a lower, i.e., depressed, position with respect to a tip portion of the guide ribs 122*h*. Thereby, the sheet P can be prevented from coming into contact with the abutment portions 122*d* more reliably.

Further, the abutment portions 122*d* according to the present embodiment are provided at a lower side than the center position in the vertical direction of the vertical-path guide surface 122*b*. Therefore, the stoppers 123 can be provided at a position closer to the position of the vertical-path guide surface 122*b* in the close state as compared to a case where the angle of regulation of pivoting of the duplex guide 122 is the same but the abutment portions 122*d* are provided at an upper side than the center position in the vertical direction of the vertical-path guide surface 122*b*. Thus, the size of the apparatus in the pivoting direction of the duplex guide 122, i.e., left-and-right direction of FIG. 2, can be downsized.

MODIFIED EXAMPLE

Next, a modified example of the sheet feeding apparatus 100C according to the present embodiment will be described with reference to FIGS. 8 and 9. The duplex guide 122 according to the present modified example has a lifting slope

122*s*, i.e., slope portion, lifting up the sheet P, arranged upstream in the sheet feeding direction of the abutment portion 122*d*. The other configurations are similar to the sheet feeding apparatus 100C described earlier, so the common components are assigned with the same reference numbers, and descriptions thereof are omitted.

Figure 8:
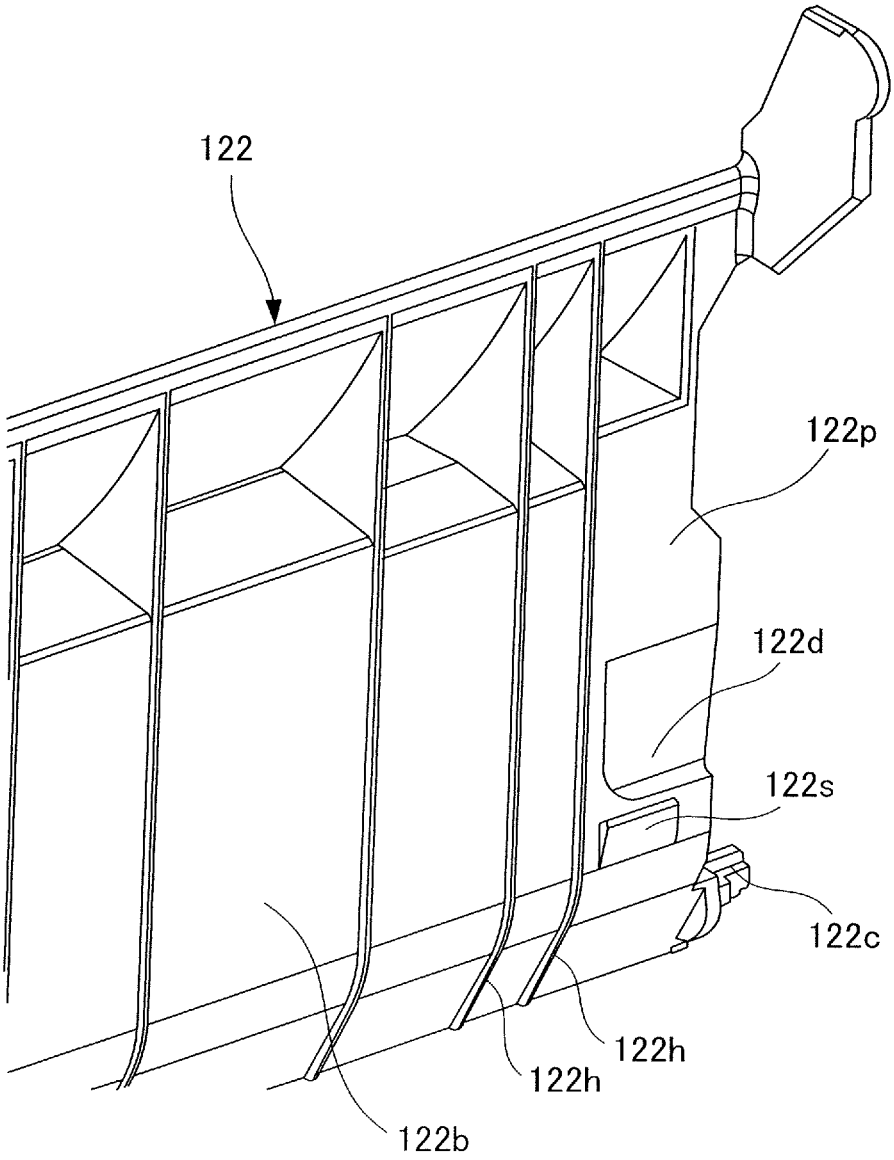
FIG. 8 is a perspective view of the duplex guide according to a modified example of the present embodiment.
Figure 9A:
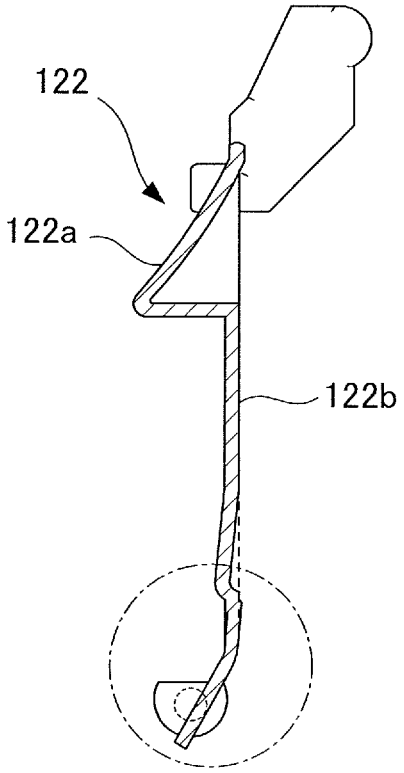
FIG. 9A is a cross-sectional view of the duplex guide according to the modified example of the present embodiment.
Figure 9B:
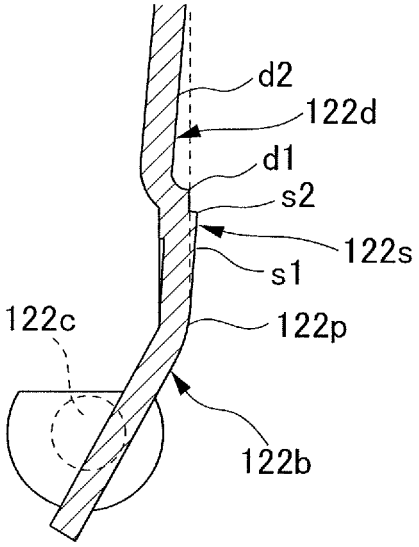
FIG. 9B is a cross-sectional view having enlarged the area shown in FIG. 9A.

The lifting slope 122*s* is provided upstream, i.e., lower side, in the sheet feeding direction of the abutment portion 122*d* and overlaps with the abutment portion 122*d* in the width direction, as illustrated in FIG. 8. As illustrated in FIGS. 9A and 9B, the lifting slope 122*s* includes an inclined portion s1 formed on an upstream side and inclined smoothly and raised successively from the flat surface 122*p*, and a stepped portion s2 formed on a downstream side and dropped from the inclined portion s1 to the height of the flat surface 122*p* in a step-like shape. The area where the inclined portion s1 and the stepped portion s2 adjoin has a greatest height with respect to the flat surface 122*p*, and the height is set to be equal to or smaller than the height of the guide rib 122*h* closest to the lifting slope 122*s*. This arrangement enables to prevent the lifting slope 122*s* from interfering with the conveyance of the sheet P.

In the sheet feeding apparatus 100C according to this modified example, when the sheet P conveyed upward through the vertical path 126 passes an end portion in the width direction of the vertical-path guide surface 122*b*, the sheet P passes the lifting slope 122*s* before passing the position corresponding to the abutment portion 122*d*. In the present example, the height difference between the abutment portion 122*d* and the vertical-path guide surface 122*b* arranged on the upstream side of the abutment portion is set greater by a height corresponding to the height of the stepped portion s2 of the lifting slope 122*s* as compared to the above-described embodiment, so that it becomes possible to more reliably prevent the sheet P from being in contact with the abutment portion 122*d*. Therefore, even if the sheet P is curled in the width direction or in the sheet feeding direction, the present modified example is able to prevent the sheet P from being in contact with the abutment portion 122*d* and assures the conveyance performance of the sheet P more reliably, in addition to the effects of the above-described embodiment.

Other Embodiments

In the illustrated embodiment, the sheet conveyance unit 104 is configured as a portion of the sheet feeding apparatus 100C, but it is also possible to provide the conveyance unit as a sheet conveyance apparatus, such as a reverse conveyance unit 201D, conveying the sheet P independently from the sheet feeding apparatus. In that case, the guide member is not necessarily configured to have both sides set as guide surfaces, such as in the case of the duplex guide 122, and the guide member should merely at least have a guide surface on the side opposing to the cover member.

Further, the openable cover 124 is provided pivotally in the left-and-right directions around the cover pivot shaft 124*b* disposed on the lower portion of the cover, but the pivot axis of the cover can be provided at the upper portion or the side portion. As another example, a slide-type cover member can be provided instead of the pivotable openable cover 124, or the cover may be a cover member that can be detached from the apparatus body 201A. In conclusion, any cover member can be adopted as long as it can be switched between a close state covering a portion of the apparatus body 201A and an open state exposing the duplex guide 122, i.e., guide member.

The duplex guide 122, i.e., guide member, is not restricted to a member pivoting along the left-and-right directions, but can adopt a configuration where the guide member is supported pivotally along the up-and-down directions for example. The guide member, i.e., duplex guide 122, according to the present embodiment adopts a configuration where it pivots in the outer direction of the apparatus body 201A along with the opening operation of the openable cover 124, but the guide member can also adopt a configuration where it pivots after the cover member has been switched from the close state to the open state. Moreover, the embodiment is not restricted to a configuration where the guide member pivots by its own weight, but the guide member can adopt a configuration where it pivots by receiving biasing force from a biasing member such as a coil spring.

Further, the stopper 123, i.e., regulation portion, is not restricted to a configuration where it is provided integrally with the exterior cover 127, but can be an independent member fixed to the apparatus body 201A. As long as the regulation portion regulates the pivoting of the guide member by being in contact with the abutment member in a state where the regulation portion is supported on the apparatus body 201A at least when the cover member is in the open state, a portion or all of the regulation portion can be designed to move with respect to the apparatus body.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-156177, filed on Aug. 6, 2015, which is hereby incorporated by reference herein in its entirety.

What is claimed is:

1. A sheet conveyance apparatus comprising:

an apparatus body;

a cover member comprising a first guide surface configured to guide a sheet, the cover member being configured to switch between a close state and an open state with respect to the apparatus body;

a guide member supported on the apparatus body pivotally to an outer side of the apparatus body, the guide member comprising:

a second guide surface opposing to the first guide surface and comprising a flat surface and ribs, the ribs being projected from the flat surface and extending along a sheet conveyance direction; and an abutment portion formed to be depressed in the flat surface of the second guide surface;

a conveyance unit configured to convey a sheet in the sheet conveyance direction through a path between the first guide surface and the second guide surface; and a regulation portion supported on the apparatus body, the regulation portion being formed to abut against the abutment portion so that a pivot angle of the guide member is regulated not to exceed a predetermined angle in a state where the cover member is switched from the close state to the open state.

2. The sheet conveyance apparatus according to claim 1, wherein the guide member pivots to the outer side of the apparatus body along with the switching of the cover member from the close state to the open state.

3. The sheet conveyance apparatus according to claim 1, wherein the abutment portion is positioned within a range corresponding to a maximum width of a sheet to be conveyed by the conveyance unit with respect to a sheet width direction orthogonal to a sheet conveyance direction.

4. The sheet conveyance apparatus according to claim 1, wherein the guide member comprises a third guide surface guiding a sheet on an opposite side from the second guide surface.

5. The sheet conveyance apparatus according to claim 4, wherein the guide member pivots around a pivot axis located an upstream part of the guide member in a conveyance direction of the sheet conveyed by the conveyance unit, and wherein the third guide surface is formed in a curved shape seen from a sheet width direction orthogonal to the conveyance direction, the third guide surface being connected to a downstream end of the second guide surface in the conveyance direction.

6. The sheet conveyance apparatus according to claim 1, wherein the guide member comprises a slope portion disposed upstream of the abutment portion in a sheet conveyance direction and formed inclined with respect to the flat surface such that a downstream part of the slope portion in the sheet conveyance direction protrudes higher than an upstream part of the slope portion from the flat surface.

7. The sheet conveyance apparatus according to claim 6, wherein a height of the slope portion with respect to the flat surface is equal to or smaller than a height of the ribs from the flat surface.

8. The sheet conveyance apparatus according to claim 1, wherein the abutment portion is positioned closer to a pivot axis of the guide member than a center position, in the sheet conveyance direction, of the second guide surface.

9. The sheet conveyance apparatus according to claim 1, wherein the abutment portion comprises a first abutment portion and a second abutment portion respectively provided on one side and on another side in the sheet width direction orthogonal to a sheet conveyance direction, and the regulation portion comprises a first regulation portion configured to abut against the first abutment portion, and a second regulation portion configured to abut against the second abutment portion.

10. An image forming apparatus comprising:

an apparatus body;

an image forming portion provided in the apparatus body and configured to form an image on a sheet; and the sheet conveyance apparatus according to claim 1, the sheet conveyance apparatus being configured to convey the sheet.

11. The image forming apparatus according to claim 10, further comprising:

a first sheet storage portion provided below the image forming portion and storing sheets; and a second sheet storage portion provided below the first sheet storage portion and storing sheets, wherein the guide member comprises a third guide surface guiding the sheet at an opposite side from the second guide surface, the second guide surface being configured to guide the sheet conveyed from the second sheet storage portion toward the image forming portion, and the third guide surface being configured to guide the sheet conveyed from the first sheet storage portion to the image forming portion.

* * * * *